United States Patent [19]

van der Heiden et al.

[11] 4,173,379

[45] Nov. 6, 1979

[54] DRAWER, PARTICULARLY FOR A CARD INDEX

[75] Inventors: George L. van der Heiden, Bergambachterstraat 3, Schoonhoven, Netherlands; Karl H. Larsson, Hoornaar, Netherlands

[73] Assignee: George Laurens van der Heiden, Schoonhoven, Netherlands

[21] Appl. No.: 789,618

[22] Filed: Apr. 21, 1977

[30] Foreign Application Priority Data

Apr. 23, 1976 [NL] Netherlands ..... 7604347

[51] Int. Cl.[2] ..... A47C 88/04; A47C 47/02

[52] U.S. Cl. ..... 312/330 SM; 220/4 F; 312/257 SM

[58] Field of Search ..... 312/257 R, 257 SM, 257 SK, 312/330; 220/4 F, 77, 3.92, 3.94

[56] References Cited

U.S. PATENT DOCUMENTS

| | | | |
|---|---|---|---|
| 1,015,455 | 1/1912 | Neeshman | 206/45.16 |
| 1,072,820 | 9/1913 | Carnes | 312/330 |
| 1,316,061 | 9/1919 | Rotenberger | 312/257 SM |
| 1,521,512 | 12/1924 | Ebbert | 220/4 R |
| 1,656,497 | 1/1928 | Paulson et al. | 220/4 R |
| 1,909,136 | 5/1933 | Thomas, Jr. | 312/257 R |
| 1,917,980 | 7/1933 | Kelsey | 312/330 |
| 2,185,770 | 1/1940 | Larson | 220/4 R |
| 2,530,849 | 11/1950 | Wyatt et al. | 220/4 F |
| 2,704,699 | 3/1955 | Evans | 312/330 |
| 2,732,273 | 1/1956 | Schaffner | 312/257 SK |
| 3,302,017 | 1/1967 | Hanson et al. | 220/77 |
| 3,370,736 | 2/1968 | Wilentchik | 220/4 F |
| 3,819,247 | 6/1974 | Evans | 312/330 |

FOREIGN PATENT DOCUMENTS

| | | | |
|---|---|---|---|
| 128514 | 7/1948 | Australia | 220/4 F |
| 835535 | 9/1950 | Fed. Rep. of Germany | 220/77 |
| 1364089 | 5/1964 | France | 312/257 SM |
| 504825 | 12/1954 | Italy | 220/4 F |

*Primary Examiner*—Mervin Stein
*Assistant Examiner*—Alexander Grosz
*Attorney, Agent, or Firm*—Scully, Scott, Murphy & Presser

[57] ABSTRACT

A card index drawer comprising bottom (2) and wall panels (3, 4, 5, 6) manufactured as individual parts, having panel connections formed by pairwise interengaging marginal portions (9, 11, 12, 15, 17, 18) of adjacent panels, effected by mutual telescoping, wherein stop members (27, 28) or stop members (25, 26) can be provided which determine the assembly end position of the telescoping of marginal portions of adjacent panels in the sense of sliding into one another, and prevent marginal portions of adjacent panels from telescoping in the sense of sliding out of the assembly end position.

1 Claim, 3 Drawing Figures

DRAWER, PARTICULARLY FOR A CARD INDEX

The present invention relates to a drawer, particularly a card index drawer comprising a bottom panel and four wall panels.

Such drawers are applied in great numbers and are consequently shipped by the relevant manufacturers in great numbers, which involves a great transport volume and consequently raises the ultimate cost price.

The object of the invention is to provide a drawer which is transportable in a relatively small volume and which can also have a rational and reliable construction.

A drawer according to the invention is provided with bottom and wall panels manufactured as individual parts, having panel connections formed by pairwise interengaging marginal portions of adjacent panels, effected by mutual telescoping. The construction may have stop members determining the assembly end position of the telescoping of marginal portions of adjacent panels in the sense of sliding into one another, and also stop members preventing marginal portions of adjacent panels from telescoping in the sense of sliding out of the assembly end position.

The individual panels can be transported in a compact volume, and can be quickly assembled in the place where the drawer is to be used, while a reliable assembly of the wall panels and the bottom panel is obtained with certainty.

According to the invention, a specially preferred embodiment is obtained if two opposite wall panels are connected to the bottom panel by telescoping of marginal portions and the two other wall panels are connected to the two former wall panels by telescoping of marginal portions and at least the front wall of the other wall panels is contiguous to the bottom panel with a bent-over lip. The bent-over lip can be contiguous with the bottom panel via a self-adhesive strip.

The invention will now be elucidated in more detail with reference to the drawings showing a few embodiments of a drawer according to the invention by way of example. The drawings show in perspective view in FIG. 1 a first embodiment of the drawer; in FIG. 2 on an enlarged scale the embodiment of FIG. 1 of the bottom and the long sidewalls and the front wall partly and fully in a disassembled position; and in FIG. 3 a corner part of a second embodiment.

Figure 1:
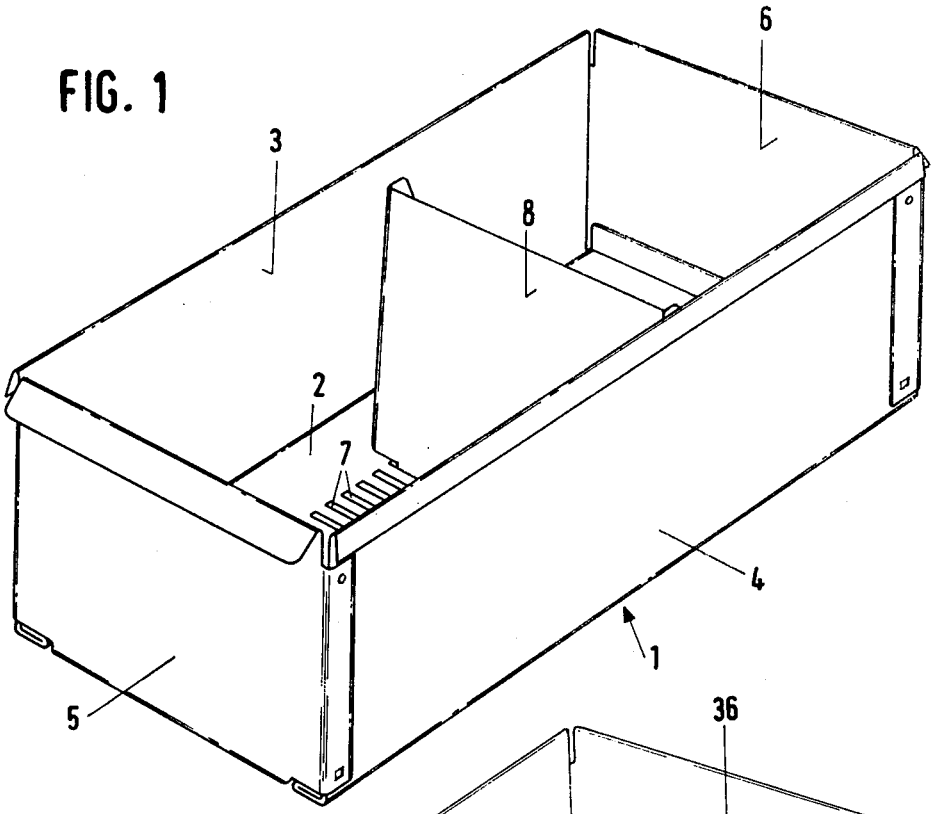
Figure 2:
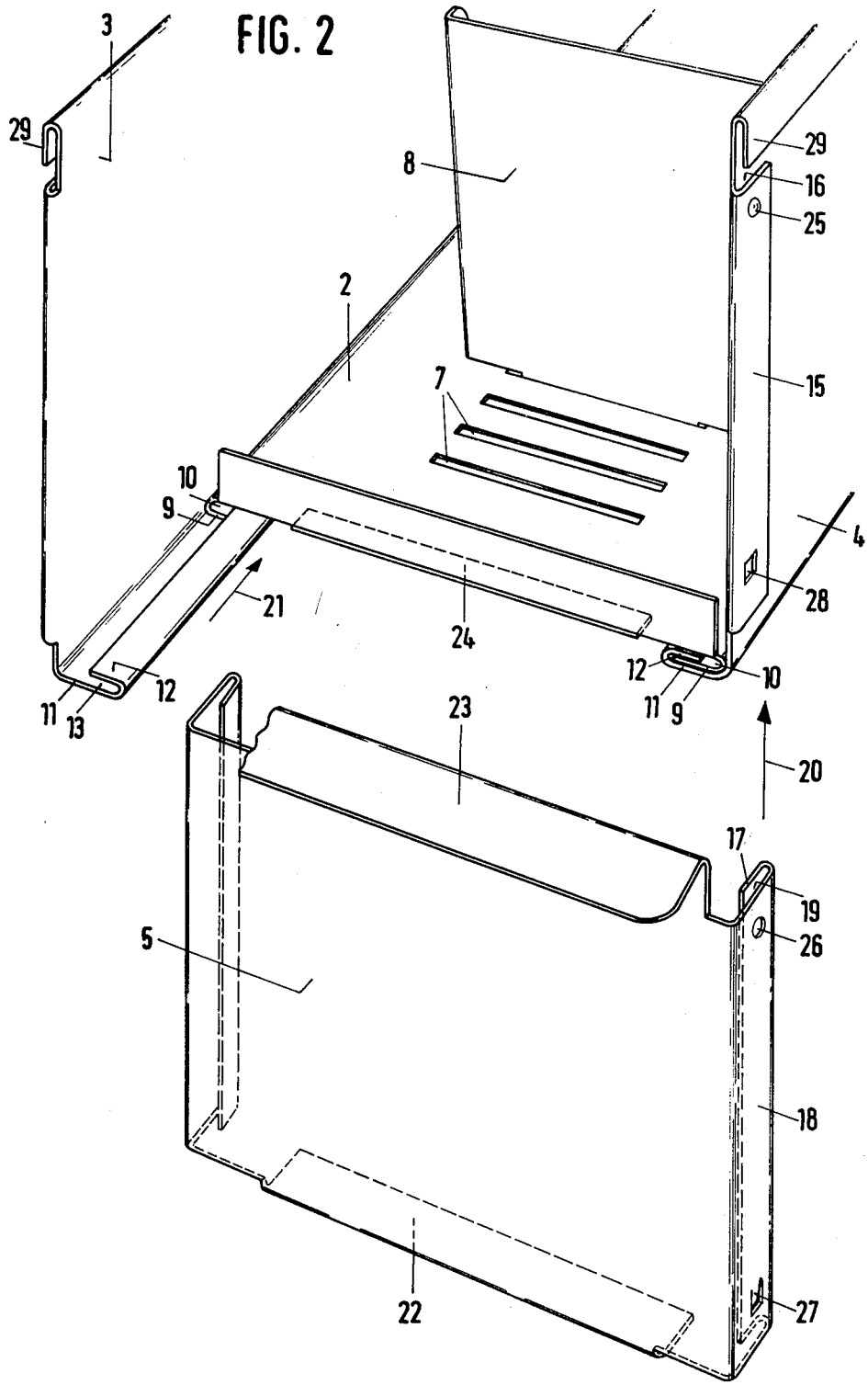

The drawer 1 of sheet metal shown in FIGS. 1 and 2 comprises a bottom 2, sidewalls 3 and 4, a front wall 5 and a rear wall 6. Bottom 2 includes a number of narrow openings 7 in which optionally one or more card supports 8 can be removably inserted.

Of bottom 2 the two long marginal strips 9 are bent through 180° so as to form facing open slots or rabbets 10 below the bottom, the opening width of which slots or grooves corresponds substantially with the thickness of walls 3 and 4.

Of walls 3 and 4 the lowermost marginal zones 11 are bent through 90° and the narrower marginal strips 12 of marginal zones 11 are bent in the same sense of rotation with respect to marginal zones 11 through 180° in such a manner that the outer edge of the marginal strips 12 is spaced from the main face of the associated walls 3 and 4 and marginal strips 12 form rabbets 13 with marginal zones 11 into which marginal strips 9 of bottom 2 can be inserted with a sliding fit, the marginal strips 12 sliding into the rabbets formed between marginal strips 9 and bottom 2.

Vertical marginal strips 15 of walls 3 and 4 are bent outwardly in the same way as bottom marginal strips 9 through 180° to form rabbets 16 with walls 3 and 4, into which rabbets the marginal strips 17 of wall 5 can be inserted. The marginal strips 17 are bent through 180° with respect to marginal zones 18, thereby forming rabbets 19, the marginal zones 18 being bent through 90° with respect to wall 5. Marginal strips 15 and 17 can be inserted into rabbets 19 and 16, respectively, in the direction of arrow 20 in FIG. 2, after wall 3 in FIG. 2 has been moved in the direction of arrow 21 into the position corresponding with that of wall 4 in FIG. 2.

Rear wall 6 and the rear marginal zones, likewise bent through 90°, of walls 3 and 4 are also provided with bent marginal strips, fully in accordance with those of front wall 5 and the foremost marginal zones of walls 3 and 4, so that rear wall 6 can be assembled with bottom 2 and walls 3 and 4 in the same way as front wall 5.

Front wall 5 has at its lower end a perpendicularly bent lip 22, on which bottom 2, with the weight of the filling in case of a filled drawer, rests when the drawer is lifted up by means of lip 23 at the upper end of front wall 5. To the lower side of bottom 2 is applied a pressure-sensitive strip 24 adhering on both sides, to which lip 22 adheres as soon as front wall 5 is in the end position of the assembly, so that the front wall is prevented from falling back.

Front wall 5 could also be prevented from falling back by a more clamping sliding fit of members 15–18; with a view to an easily feasible assembly the smoothly sliding fit will normally be preferred, however.

To stop front wall 5, also stop members in the form of cut-out lips, small projections, blanks and the like can be applied. By way of example, FIG. 2 shows in marginal strip 15 an outwardly flanged semisphere 25, which in the end position of front wall 5 snaps in hole 26 in marginal zone 18. Similarly, lip 27 cut from marginal zone 18 and the rectangular hole 28 can mate in marginal zone 15.

In a drawer designed for a card index it is usually not necessary to provide it with a cover. If a cover is desirable, marginal zones and marginal strips thereof can be bent, such as 18 and 17 of front wall 5, to form sliding joints with upper edges 29—bent through 180°—of walls 3 and 4. If lip 22 is not used, edges 29 can also serve as stops cooperating with the upper end of the bent transition between the marginal strips 17 and the marginal zones 18 of the front and rear walls 5 and 6, to define the assembly end positions of these walls.

Of the first embodiment shown, all parts are made of sheet metal. It is also possible to make these parts or one or a few thereof of a thermosetting or a thermoplastic material, of which the telescopic marginal portions will have a form adapted to the nature of this material and to its design.

Figure 3:
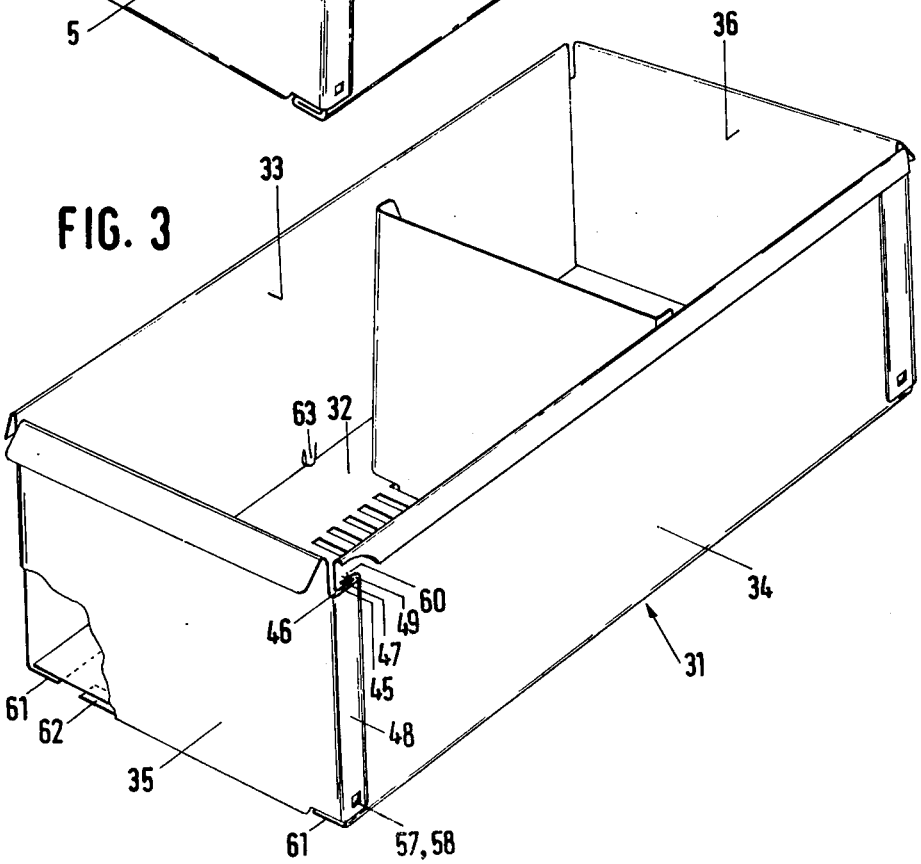

FIG. 3 shows part of a second embodiment, indicated by 31 and the bottom is designated by 32, the sidewalls by 33 and 34 and the front wall by 35.

The sidewalls have vertical marginal strips 45 bent through 180°, which strips form rabbets 46 with walls 33, 34. The front and rear wall have vertical marginal zones 48 bent through 90°, with respect to which their marginal strips 47 are bent through 180°, so that they form rabbets 49. In the same way as described in connection with sidewalls 3–6 in FIGS. 1 and 2, members 45–49 form telescopic joints between sidewalls 33–36, the assembly end position of which is defined by stop lips and holes 57 and 58, respectively, as well as stops cooperating with marginal strips 47, said stops being formed by flanged members 60 of sidewalls 33, 34.

The sidewalls and the front and rear wall have at their lower end perpendicularly bent supporting edge strips 61 and 62, on which bottom 32 is laid after assembly of the sidewalls.

To this end use can be made of stops 63 in the form of recesses in sidewalls 33, 34, which prevent bottom 32 from falling out. When bottom 32 is laid in, it can pass stops 63 by flexibly bending bottom 32 and/or sidewalls 33, 34.

The laid-in bottom imparts stability of form to the assembly of the four walls or increases its original strength.

Stops 63 and supporting edge strips 61 can also be used as a telescopic joint between bottom 32 and sidewalls 33, 34, in which case the front or rear wall, after insertion of the bottom, is assembled last.

We claim:

1. A drawer comprising:

a. an individual bottom panel and first and second pairs of oppositely situated individual wall panels, said second pair of wall panels extending along the length of the drawer, and means for connecting adjacent wall panels together including mutually telescoping portions, in a vertical direction, on adjacent panels, including each telescopic connection comprising a marginal zone on each side of each of said first pair of wall panels bent from the panel through 90° in the direction of the other panel to be connected thereto, and further bent through 180° with a marginal strip being located in a plane substantially parallel to that of said portion bent through 90°, and on each side of each of said second pair of panels a marginal zone bent through 180° outwardly with respect to the panel to be connected thereto, with two bends through 180° being such that the marginal zones are telescoping one into the other with a sliding fit;

b. means for connecting the bottom panel and said second pair of oppositely situated wall panels together including mutually telescoping portions in a longitudinal direction on the marginal adjacent portions of the bottom panel and the second pair of oppositely situated wall panels, each telescopic connection comprising a marginal zone bent from each of said second pair of wall panels through 90° in the direction of the bottom panel, and further bent through 180° with a marginal strip being located in a plane substantially parallel to that of said portion bent through 90°, and on the bottom panel a marginal zone bent through 180° from the bottom panel outwardly with respect to wall panel to be connected thereto, which two bends through 180° being such that the marginal zones are telescoping one into the other with a sliding fit;

c. stops formed on the panels to determine the assembly end position of telescoping of the marginal portions of adjacent panels in the direction of sliding into one another;

d. stop members stopping the telescopic movement of marginal zones of adjacent panels in the sense of sliding out of the assembly end position, said stop members being formed by one or more recessed portions in a marginal zone of a panel mating with one or more projections in a corresponding marginal zone of the adjacent panel; and e. one of said first pair of wall panels forming the front of the drawer and being contiguous to the bottom panel with a lip bent through 90° towards the bottom panel, and said bent lip being contiguous to the bottom panel through a self-adhesive strip.

* * * * *